US011517059B2

(12) United States Patent
Bolker

(10) Patent No.: US 11,517,059 B2
(45) **Date of Patent: *Dec. 6, 2022**

(54) GARMENT WITH CELL PHONE POCKETS

(71) Applicant: Cynthia Bolker, Del Mar, CA (US)

(72) Inventor: Cynthia Bolker, Del Mar, CA (US)

( * ) Notice: Subject to any disclaimer, the term of this patent is extended or adjusted under 35 U.S.C. 154(b) by 130 days.

This patent is subject to a terminal disclaimer.

(21) Appl. No.: 16/436,625

(22) Filed: Jun. 10, 2019

(65) Prior Publication Data

US 2019/0373970 A1 Dec. 12, 2019

Related U.S. Application Data

(60) Provisional application No. 62/683,941, filed on Jun. 12, 2018.

(51) Int. Cl.

| | |
|---|---|
| ***A41D 27/20*** | (2006.01) |
| ***A41B 9/00*** | (2006.01) |
| ***A41D 1/06*** | (2006.01) |
| ***A41D 1/00*** | (2018.01) |
| *A41B 9/14* | (2006.01) |

(52) U.S. Cl.

CPC ..... *A41D 27/205* (2013.01); *A41B 9/001* (2013.01); *A41D 1/002* (2013.01); *A41B 9/14* (2013.01); *A41D 1/06* (2013.01); *A41D 2300/22* (2013.01); *A41D 2300/33* (2013.01); *A41D 2600/10* (2013.01)

(58) Field of Classification Search

CPC . A41D 1/06; A41D 1/08; A41D 1/089; A41D 1/002; A41D 27/205; A41D 2600/10; A41B 9/001; A41B 9/04

See application file for complete search history.

(56) References Cited

U.S. PATENT DOCUMENTS

| | | | |
|---|---|---|---|
| 1,529,154 | A | 3/1925 | Block |
| 2,498,048 | A | 2/1950 | Neinken |
| 2,544,840 | A | 3/1951 | Kowatsch |
| 5,598,586 | A | 2/1997 | Munjone |

(Continued)

OTHER PUBLICATIONS

Non-Final Office Action dated Dec. 16, 2021 for U.S. Appl. No. 16/425,066, 38 pages.

(Continued)

*Primary Examiner* — Katherine M Moran

(74) *Attorney, Agent, or Firm* — Kilpatrick Townsend & Stockton LLP

(57) ABSTRACT

This invention is directed toward a garment that is comfortable to wear and can safely, with easy accessibility, securely and inconspicuously store a cell phone and other important items. A preferred embodiment of the invention is a pair of shorts, with an elasticized waistband that can be tightened by a non-elasticized drawstring cord. There is a seamless, knitted inner layer similar to "boy short" style underwear. This seamless, knitted "boy short" style underwear inner layer provides comfort to the user. Two vertical side hip interior pockets are sewn onto the inner liner of the seamless, knitted "boy short" underwear at the hips of the user, making it comfortable for a user to carry a cell phone and/or other items. The shorts have a thin line of reflective fabric sewn into the hip seams and on the hem of the shorts, providing safety for the user during times of low visibility.

14 Claims, 11 Drawing Sheets

(56) References Cited

U.S. PATENT DOCUMENTS

| | | | | |
|---|---|---|---|---|
| 5,649,328 | A | 7/1997 | Martin | |
| 6,041,442 | A | 3/2000 | Owen | |
| 6,145,132 | A * | 11/2000 | Towner | A41B 9/02 2/400 |
| 2004/0040068 | A1 | 3/2004 | Silver | |
| 2006/0150302 | A1 | 7/2006 | Warren et al. | |
| 2012/0135215 | A1 | 10/2012 | Franz | |
| 2013/0014311 | A1 | 1/2013 | Chapuis | |
| 2013/0091619 | A1* | 4/2013 | Hacker | A41D 1/08 2/228 |
| 2014/0259297 | A1 | 9/2014 | Garabedian | |
| 2015/0074871 | A1 | 3/2015 | Emich et al. | |
| 2015/0082516 | A1* | 3/2015 | Doan | A41D 27/20 2/220 |
| 2015/0196066 | A1 | 7/2015 | Emanuel et al. | |
| 2016/0007662 | A1 | 1/2016 | Powell | |
| 2016/0095367 | A1 | 4/2016 | Curran | |
| 2016/0095372 | A1 | 4/2016 | Peterson et al. | |
| 2016/0331053 | A1* | 11/2016 | Gordon | A41D 7/00 |
| 2017/0258158 | A1* | 9/2017 | Baiany | A41D 31/125 |
| 2017/0325531 | A1* | 11/2017 | Lomax | A41F 1/02 |
| 2017/0354192 | A1 | 12/2017 | Albano et al. | |
| 2018/0116315 | A1 | 5/2018 | Cherry et al. | |
| 2018/0228232 | A1* | 8/2018 | Fisher | A41F 9/00 |
| 2019/0159537 | A1 | 5/2019 | Blythe | |
| 2019/0174846 | A1* | 6/2019 | Puzzo | A41D 31/04 |
| 2019/0320747 | A1* | 10/2019 | Otashevich | A41D 1/14 |
| 2019/0373969 | A1* | 12/2019 | Bolker | A41D 1/089 |
| 2020/0214377 | A1 | 7/2020 | Horbatuck | |
| 2020/0229516 | A1* | 7/2020 | Curran | A41D 27/20 |

OTHER PUBLICATIONS

Final Office Action dated May 26, 2022 for U.S. Appl. No. 16/425,066, 34 pages.

Advisory Action dated Jul. 20, 2022 for U.S. Appl. No. 16/425,066, 3 pages.

Notice of Allowance dated Sep. 14, 2022 for U.S. Appl. No. 16/425,066, 10 pages.

Corrected Notice of Allowability dated Sep. 22, 2022 for U.S. Appl. No. 16/425,066, 4 pages.

* cited by examiner

GARMENT WITH CELL PHONE POCKETS

CROSS REFERENCE TO RELATED APPLICATIONS

U.S. patent application Ser. No. 16/436,625 claims priority to U.S. Provisional No. 62/683,941, entitled Garment with cell phone pockets, filed 12 Jun. 2018, the contents of which are incorporated by reference. This application is an RCE (Request for Continued Examination) from Ser. No. 16/436,625, filed Jun. 10, 2019.

STATEMENT REGARDING FEDERALLY SPONSORED RESEARCH OR DEVELOPMENT

This invention was not federally sponsored.

BACKGROUND OF THE INVENTION

Field of the invention: This invention relates to the general field of clothing, and more specifically, to a pair of shorts, pants or Capris with a specific design and the ability to comfortably, safely, and with easy accessibility carry a cell phone and other items including but not limited to, a medical device, small wallet, keys, ID, energy bars, cash and/or credit card. In a particularly preferred embodiment, a pair of shorts, pants or Capris with enhanced comfort and cell phone carrying capabilities is described in this application, but the materials and methods laid out in this application could just as easily apply to other items of clothing worn by women, men or children.

Brief Description of Invention: As discussed above, a particularly preferred embodiment of the invention is the utilitarian features of a comfortable, stylish and yet functional short, pant or Capri. To provide comfort, the shorts, pants or Capris incorporate an elasticized waistband with an interior, non-elasticized drawstring cord, so wearers can comfortably slip on the shorts, pants or Capris, and tie them more securely, if and when needed, by tightening the non-elasticized drawstring cord. Inside the shorts, pants or Capris is what is commonly known as built-in seamless "boy short" style underwear, which is comprised of a snug fitting piece of fabric that extends from the waist to the intersection between the legs and the body of the wearer. This seamless "boy short" style underwear provides an inner layer of privacy and comfort, and yet because it ends at the top of the legs of the wearer, it does not bunch up, stretch out or cause chafing, as can be the case with inner garments that extend down the legs of the wearer. The "boy short" underwear is knitted on a machine that creates a seamless inner layer, enhancing the comfort of the wearer.

Since it is anticipated that this short, pant or Capri will be worn by exercisers, walkers, joggers, golfers, hikers, travelers, sportspeople, athletes and runners who often will be in close proximity to roads, an attractive yet effective strip of reflective fabric is sewn into the seams along the sides of the shorts, pants or Capris and around the hems, which can be straight or scalloped. There are two interior vertical side hip pockets for a cell phone and/or the aforementioned items that are sewn below the waistband of the inner seamless "boy short" underwear at the hips of the wearer. Both pockets will accommodate a cell phone and the aforementioned items. These pockets keep the cell phone and other small items securely contained. The pockets are located on the sides of the shorts, pants or Capris at the hips of the wearer, so that the cell phone and/or the aforementioned items can be carried inconspicuously and comfortably, with easy accessibility. The cell phone and/or the aforementioned items will be kept stable and safely secured while maintaining accessibility to the items in the interior vertical side hip pockets sewn several inches below the waistband.

Making comfortable, functional shorts, pants or Capris has been a challenge. With the profusion of cell phones, and the transition of cell phones from a convenience to an everyday necessity that is taken to almost all activities, the additional challenge of how to effectively secure a cell phone inside shorts, pants or Capris has presented itself.

The prior art presents a number of attempts to solve this problem, but none that so effectively combine an effective container for a cell phone and/or the aforementioned items in an ideal location on the inner surface of the inner layer of the shorts, pants or Capris. This particular combination has proven to result in an extremely comfortable and useful pair of shorts, pants or Capris that prevents the exerciser, hiker, golfer, traveler, athlete, sports enthusiast, runner, walker or jogger from having the cell phone slap his/her thigh when the phone and/or the aforementioned items are contained in a pocket located on the individual's thigh; having to shove the cell phone into a woman's or girls' sports bra, which is potentially unhealthy; having to hold the cell phone in his/her hand, which can cause cramping or being strapped to a bicep, which is inconvenient and difficult, when trying to access the cell phone or music device, and can potentially reduce blood flow, create an unwanted rash, and could limit muscle contraction.

There are shorts, pants or Capris with reflective details, however these are mostly reflective patches that are glued or heat-affixed to the exterior of the shorts, pants or Capris. These tend to get damaged when washed and lose effectiveness over time. These reflective details are typically the logo of the company and do not create visibility during low-visibility times for the exerciser, runner, sports enthusiast, athlete, golfer, traveler, hiker, walker or jogger.

There are also shorts, pants or Capris with cell phone pockets, however these are usually too small, have inadequate closure methods, or are located on a part of the shorts, pants or Capris where they are inaccessible and/or uncomfortable. The existing cell phone pockets are also not well secured, such that there is a danger of the entire pocket "flipping over" the waistband or out of other pocket locations, thus potentially causing the cell phone and/or other aforementioned items to fall out, be sat on, banged, folded, knocked, or damaged.

Shorts, pants or Capris with elastic waistbands are well known, but the current invention combines an elastic waistband with a non-elasticized drawstring cord, such that the wearer can benefit from the comfort of an elastic waistband, but when he/she really needs to make sure the shorts, pants or Capris stay on, he/she can do so by tightening them with the non-elasticized drawstring cord.

Shorts, pants or Capris with inner layers are also known in the art, but this invention has built-in seamless "boy short" style underwear knitted to enhance comfort, and serves a secondary function by anchoring the cell phone pocket to the shorts.

OBJECTS OF THE INVENTION

It is therefore an object of the present invention to provide a short, pant or Capri with pockets that securely, comfortably and safely accommodate and hold a cell phone, with easy accessibility, and an elasticized waistband that prevents the shorts, pants or Capris from falling down, while wearing the shorts, pants or Capris, with a seamless "boy short" underwear as an inner layer, with reflective fabric sewn on the hems and into the hip seams.

Further objects of the invention include:

Providing shorts, pants or Capris with an effective inner layer that does not bunch up at the intersection of the legs and the body.

Providing a short, pant or Capri with a "boy short" underwear inner layer that has been knitted to be seamless.

Providing a short, pant or Capri with a non-elasticized, continuous interior drawstring cord.

Providing a short, pant or Capri with thin strips of reflective fabric sewn into the hip seams and on the hem of the short, pant or Capri.

Providing shorts, pants or Capris with pockets big enough to hold a large cell phone, located at the side of the shorts, pants or Capris at the hips of the wearer, where the pockets are sewn onto the inner liner of the inner layer of the seamless, knitted "boy short" underwear, such that the pockets are located at the hips of the wearer.

Providing shorts, pants or Capris with a straight or scalloped hem.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

Two preferred forms of the invention will now be described with reference to the accompanying drawings.

REFERENCE NUMBERS USED

Figure 1:
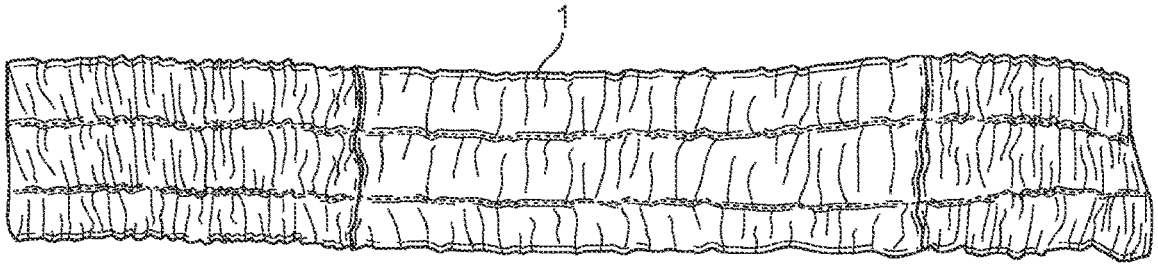
FIG. 1 is an exterior front view of the elasticized waistband portion of the invention.

1. Elasticized waistband
2. Non-elasticized drawstring cord
3. Channel inside elasticized waistband
4. Eyelet hole
5. Reflective fabric
6. Inner layer seamless "boy short" style underwear
7. Pocket
8. Pocket body
9. Pocket opening
10. (Left blank on purpose)
11. Scalloped hem
12. Insertable container, pouch or wallet
13. Cell phone
14. Outer Layer

DETAILED DESCRIPTION OF THE FIGURES

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

FIG. 1 is an exterior front view perspective of the elasticized waistband portion of the invention. The elasticized waistband 1 is roughly 2 to 3 inches in height, with an outer surface and an inner surface, stitched together at the base to form a hollow channel between the outer surface and the inner surface.

Figure 2:
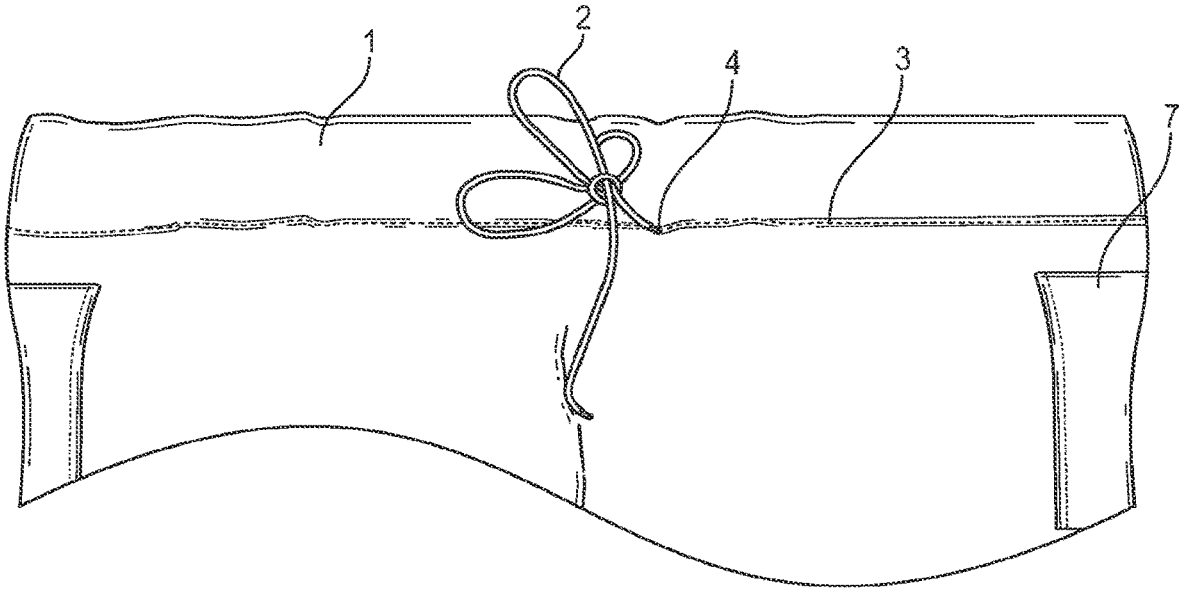
FIG. 2 is a front interior view of the non-elasticized, continuous interior drawstring cord.

FIG. 2 is a front interior view perspective of the non-elasticized, continuous interior drawstring cord. The drawstring cord 2 is movably embedded in the channel between the outer surface and the inner surface of the elasticized waistband 1. The ends of the drawstring cord extend through two eyelet holes 4 to allow a wearer of the invention to tighten the shorts as needed. On each side of the interior of the shorts is a pocket 7 which is attached on the inside of the seamless "boy short" underwear, referred to as the inner layer, where the inner layer has an outer liner which faces the short and an inner liner which faces the body where the pockets are placed at the hips of the wearer.

Figure 3:
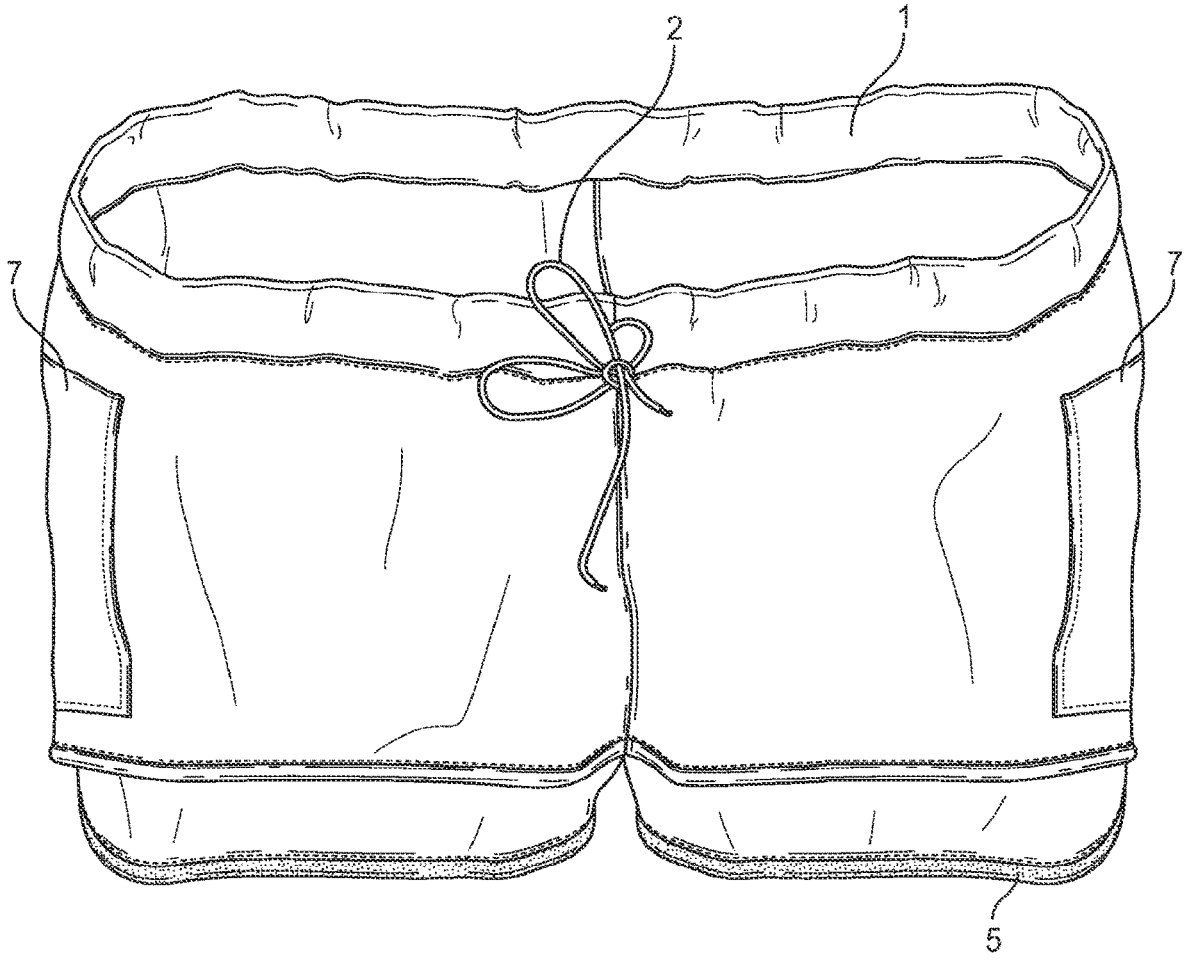
FIG. 3 is a perspective interior view of the interior pockets on each hip which are situated below the elasticized waistband and sewn into the inner liner of the inner layer built-in, seamless "boy short" style underwear with a non-elasticized, continuous interior drawstring cord and reflective fabric sewn on the hems and in the side seams of the shorts.

FIG. 3 is a perspective interior view of the interior pockets at each hip which are situated below the elasticized waistband and sewn onto the inner liner of the built-in, seamless "boy short" style underwear, with a non-elasticized, continuous interior drawstring cord and reflective fabric sewn on the hem and into the hip seams of the shorts. The reflective fabric 5, is sewn into the intersection of the front and back panels at each hip, and along the bottom seam of the shorts. This reflective fabric is superior to the prior art that teaches applying a reflective glue or overlay, which will over time potentially deteriorate during the washing of the garment. The reflective tape serves to alert cars, bicyclists, and even other exercisers, walkers, joggers, hikers, golfers or runners during low visibility times by providing bright reflection from his/her front side, backside, and side of the hips. As can be seen in this illustration, pockets 7 are relatively wide and long—specifically designed to be wide enough and long enough to hold a cell phone or other items.

Figure 4:
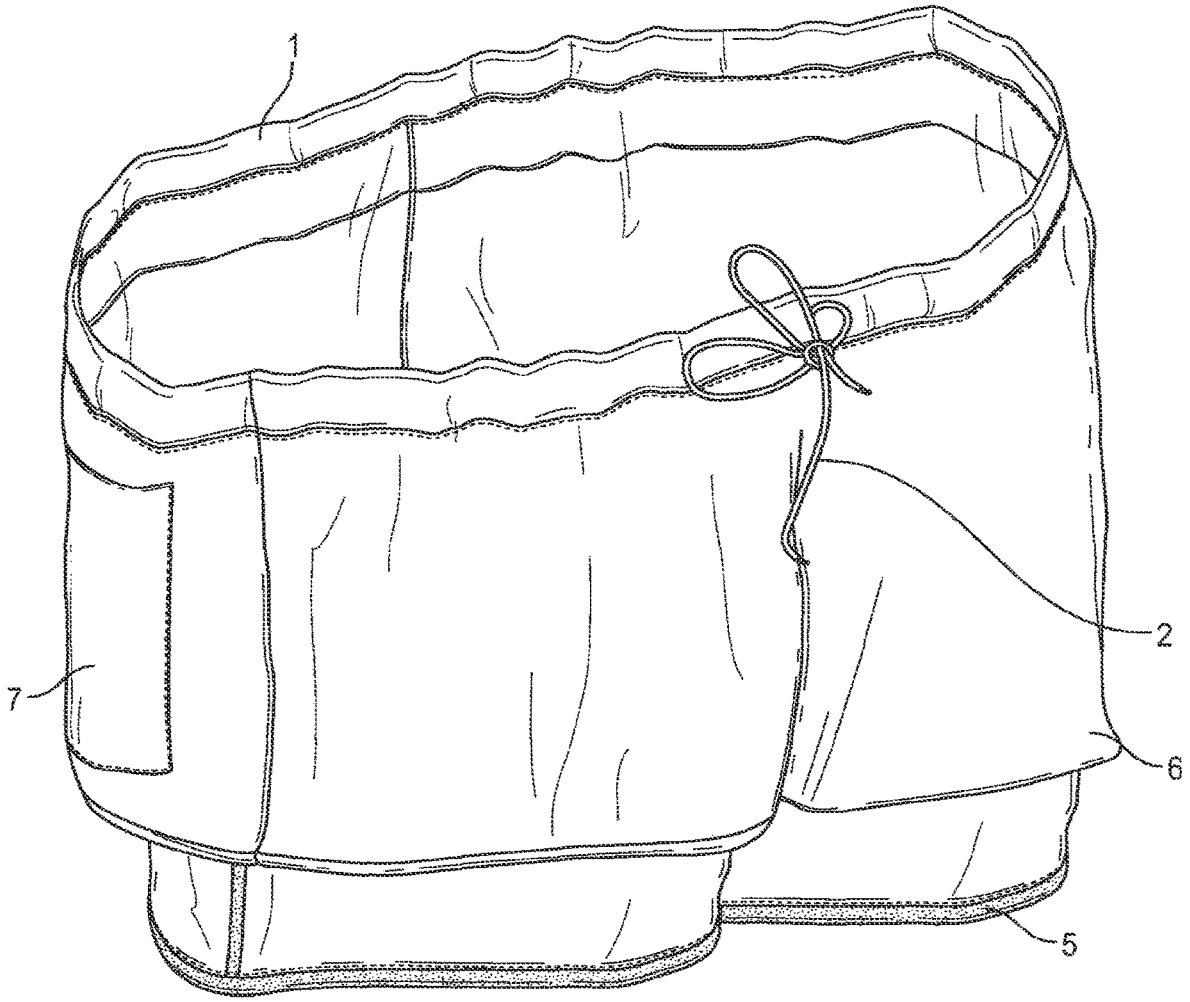
FIG. 4 is another interior perspective view of the interior pockets at each hip which are situated below the elasticized waistband and sewn into the inner liner of the inner layer built-in, seamless "boy short" style underwear with a non-elasticized, continuous interior drawstring cord and reflective fabric sewn on the hems and in the side seams of the shorts.

FIG. 4 is another perspective interior view of the interior pockets at each hip of the wearer which are situated below the elasticized waistband and sewn onto the inner liner of the built-in, seamless "boy short" style underwear with a non-elasticized, continuous interior drawstring cord and reflective fabric sewn on the hem and into the hip seams of the shorts. To enhance the comfort of the invention, an inner layer 6 is provided. The inner layer "boy short" style underwear garment portion 6, which is seamless, snugly fits around the lower torso of the wearer, but ends at the intersection of the torso and the legs, so that it doesn't slap, bunch up, stretch or chafe as the wearer walks, runs, jogs, golfs, hikes or exercises. This inner layer 6 is knitted to avoid any seams, thereby making it more comfortable for the wearer. The interior pockets 7 are sewn below the elasticized waistband 1 and to the inner layer 6, thereby making it solidly attached at both ends to the garment. This minimizes the effects on the items in the pockets 7 from excessive movements, such as slapping the thigh of the wearer, or swinging back-and-forth, side to side, and up and down while reducing potential damage to the cell phone and/or the items contained in the pockets. By placing the interior pockets 7 at the hips of the wearer, the prior art problem of cell phones placed in pockets at the front of the shorts and jabbing the wearer with every step are solved. The prior art problem of a person losing a cell phone from an exterior pocket through either pick-pocketing or just having the cell phone fall out is also solved by locating the pockets on the inner liner of the inner layer of the shorts. The interior pocket placement maintains a smooth, sleek look and feel as the items are secured more comfortably and inconspicuously with easy accessibility.

Figure 5:
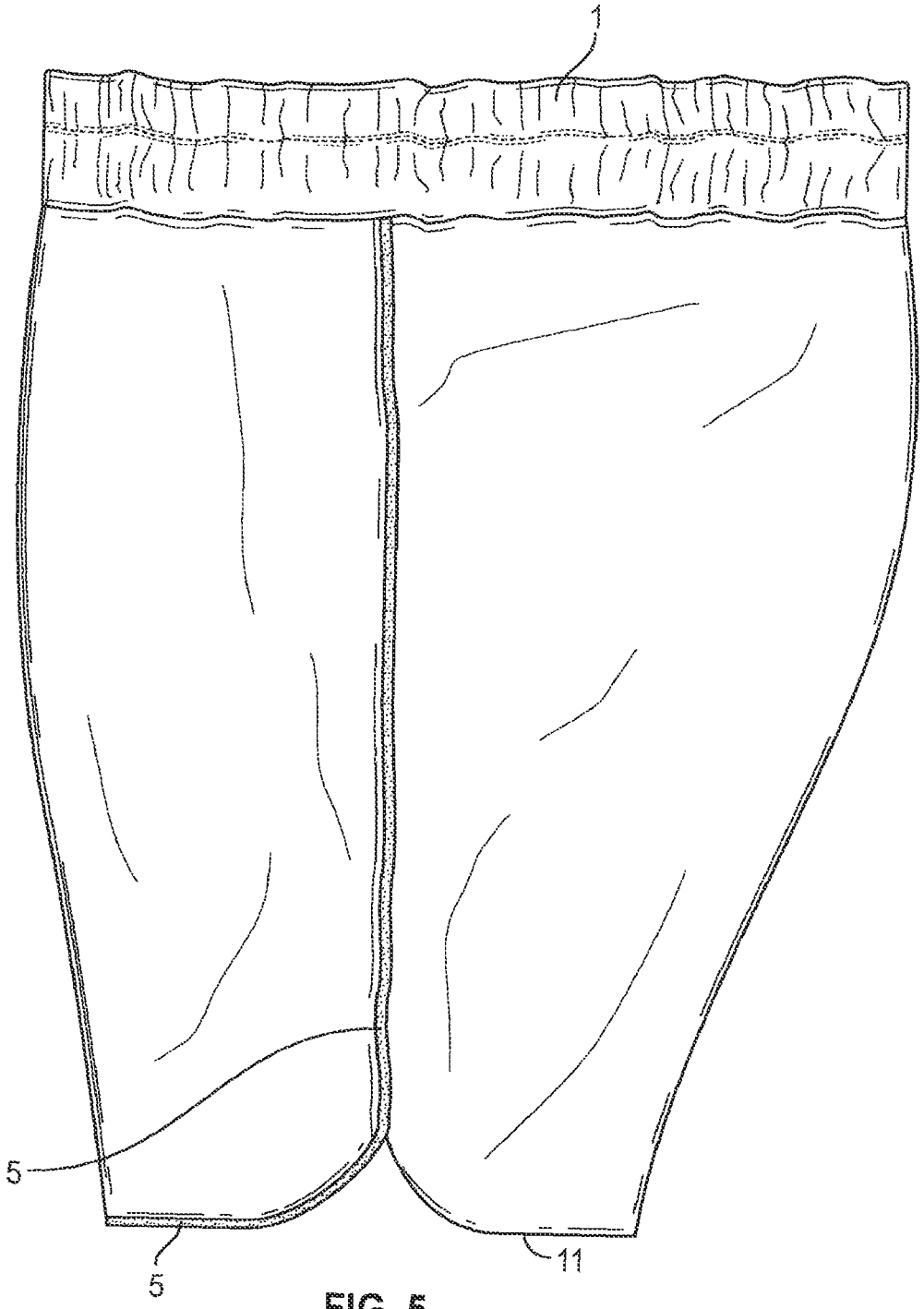
FIG. 5 is a perspective exterior view of the hem of the shorts, which can be straight or scalloped with reflective fabric sewn into the side of the hips and on the hems of the shorts.

FIG. 5 is a side exterior view of the hem of the short, which can be straight or scalloped 11, trimmed in reflective fabric 5 is sewn into the sides of the hip seams and the on the hem of the shorts.

Figure 6:
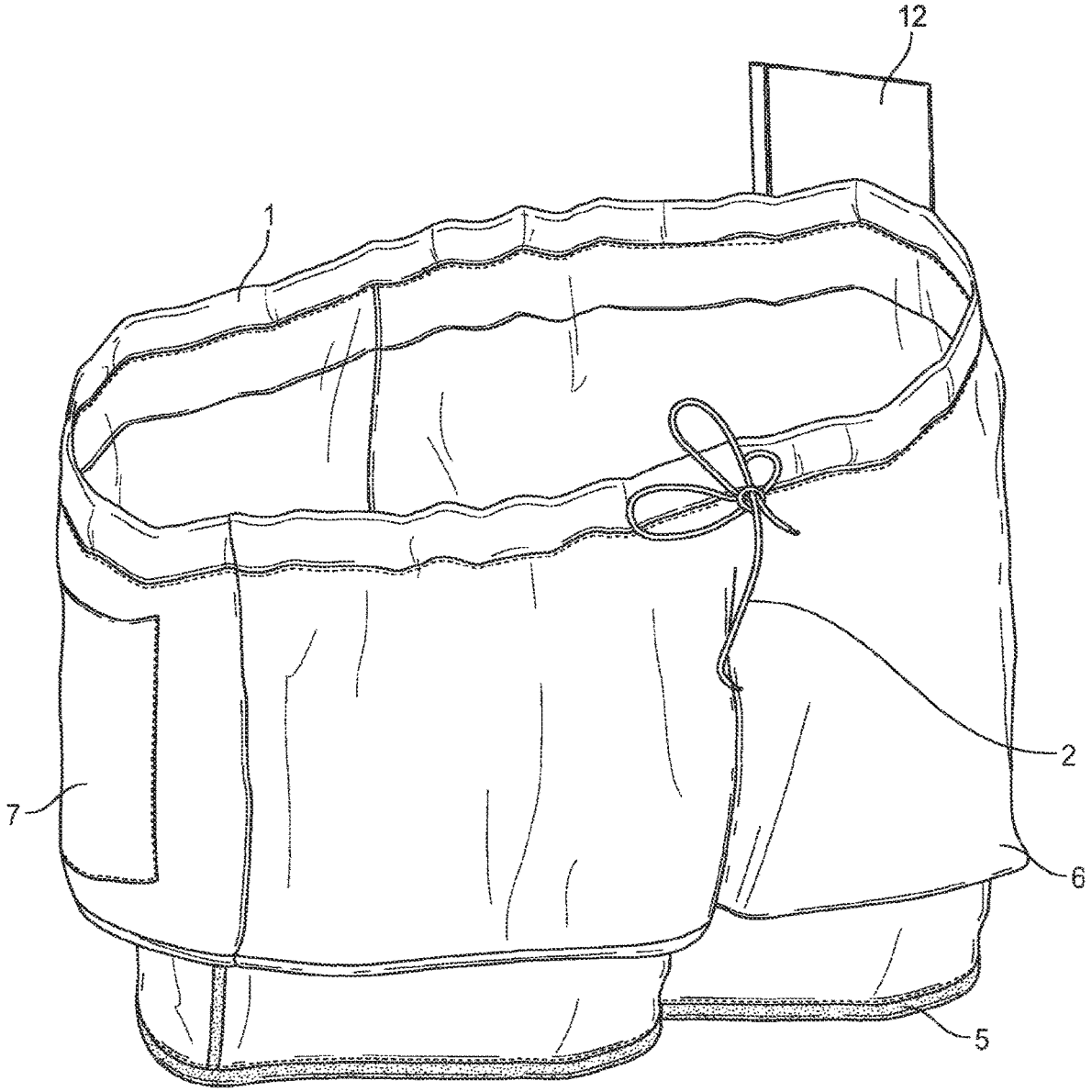
FIG. 6 is a front perspective interior view of the shorts showing the location of the two interior pockets on the side of the shorts at the hips of the wearer, and how a wearer can slide a slim insertable container, pouch or wallet and/or other items into either one of the pockets.

FIG. 6 is a front perspective interior view of the shorts showing the location of the two interior pockets 7 on the sides of the shorts and hips of the wearer, and how a wearer can slide a slim insertable container, pouch or wallet 12 (or another similarly shaped item) into one of the pockets. The insertable container, pouch or wallet 12 can house an ID, credit card, keys, medical information, and/or any other slim items that a wearer of the invention may wish to put in the container, pouch or wallet.

Figure 7:
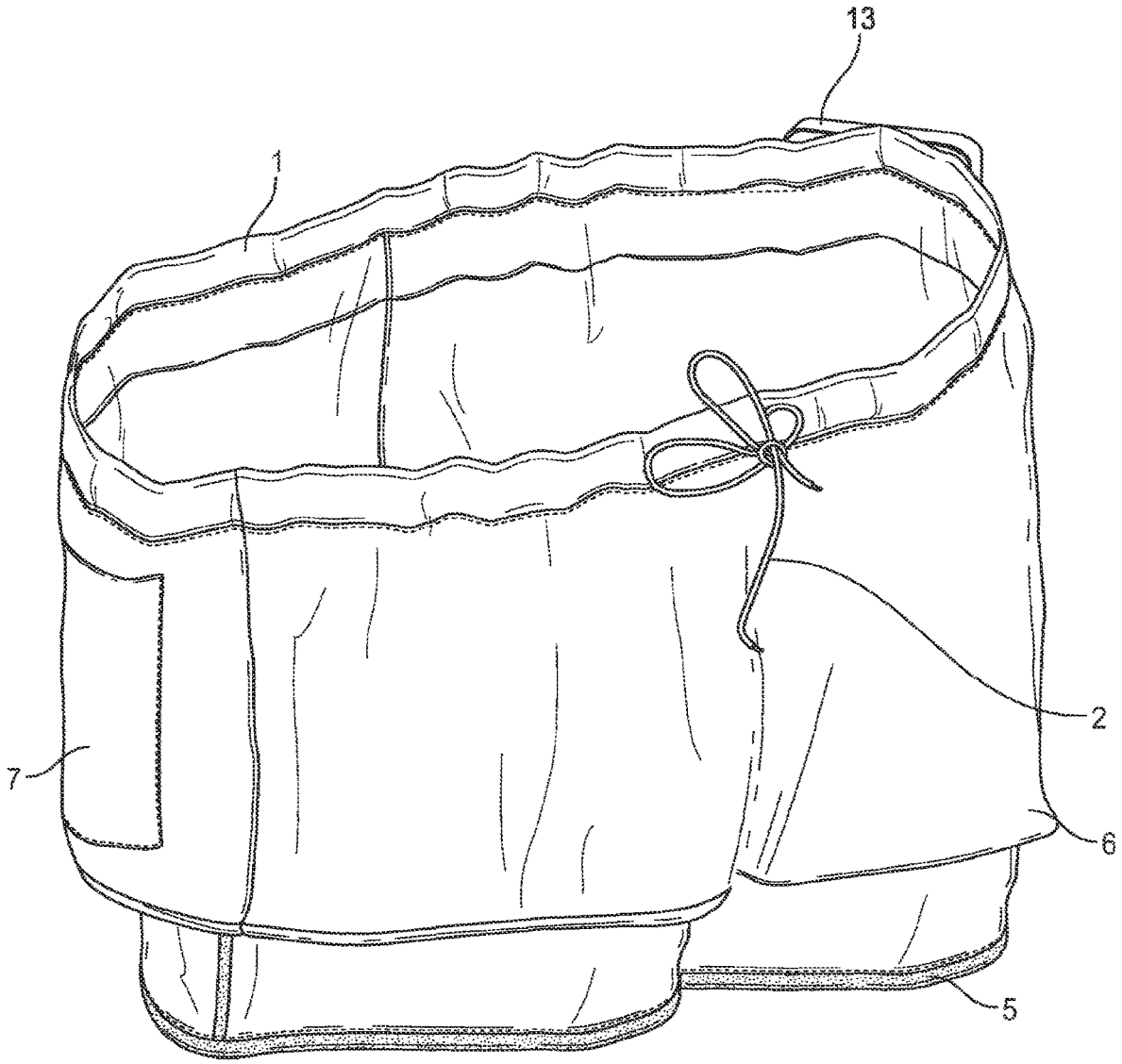
FIG. 7 is a front perspective interior view of the shorts showing the location of the two interior pockets on the sides of the shorts at the hips of the wearer, and how a wearer can slide a cell phone into either one of the pockets.

FIG. 7 is a front perspective interior view of the shorts showing the location of the two interior pockets 7 on the hips of the wearer and the sides of the shorts, exemplifying how a wearer can slide a cell phone 13 into either one of the pockets. After inserting the cell phone 13 into the pocket 7, the pocket helps to retain the cell phone and/or other item(s).

Figure 8:
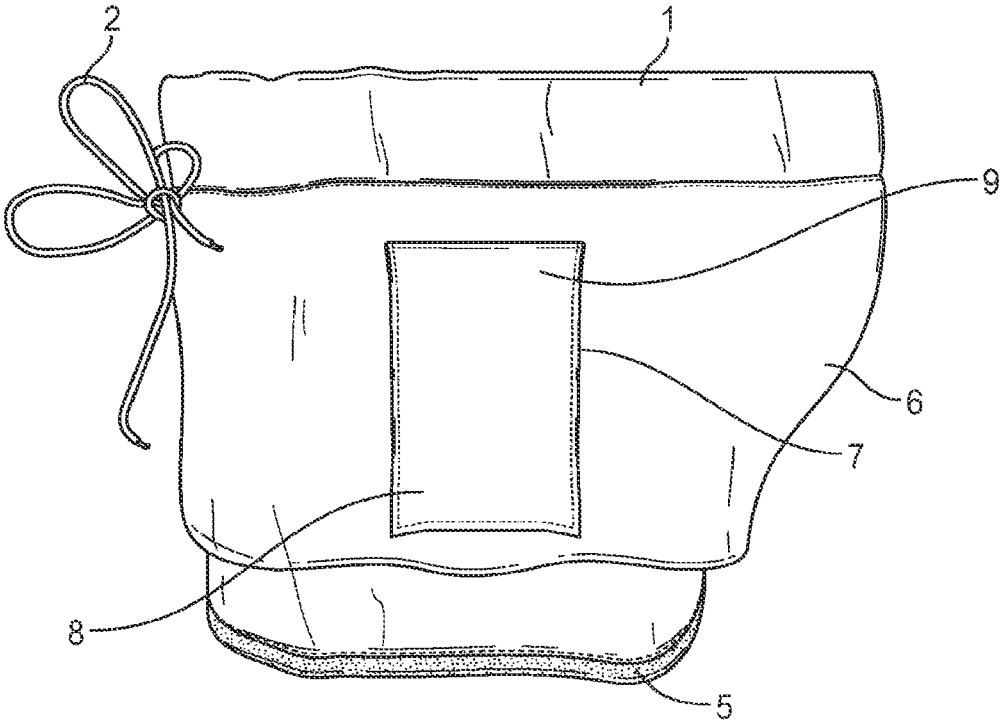
FIG. 8 is an interior side view of the shorts, showing the location of the pocket at the wearer's hip.

FIG. 8 is an interior side view of the shorts, after they have been turned inside out, showing the location of the interior pocket 7 on the side of the short at the hip of the wearer. The pocket 7, with a pocket body 8 and a pocket opening 9, is sewn to the inner liner of the "boy short" style seamless underwear 6 below the elasticized waistband 1 so that it is secure and will not bounce around when a wearer of the invention runs, walks, jogs, hikes, golfs or exercises with it.

Figure 9:
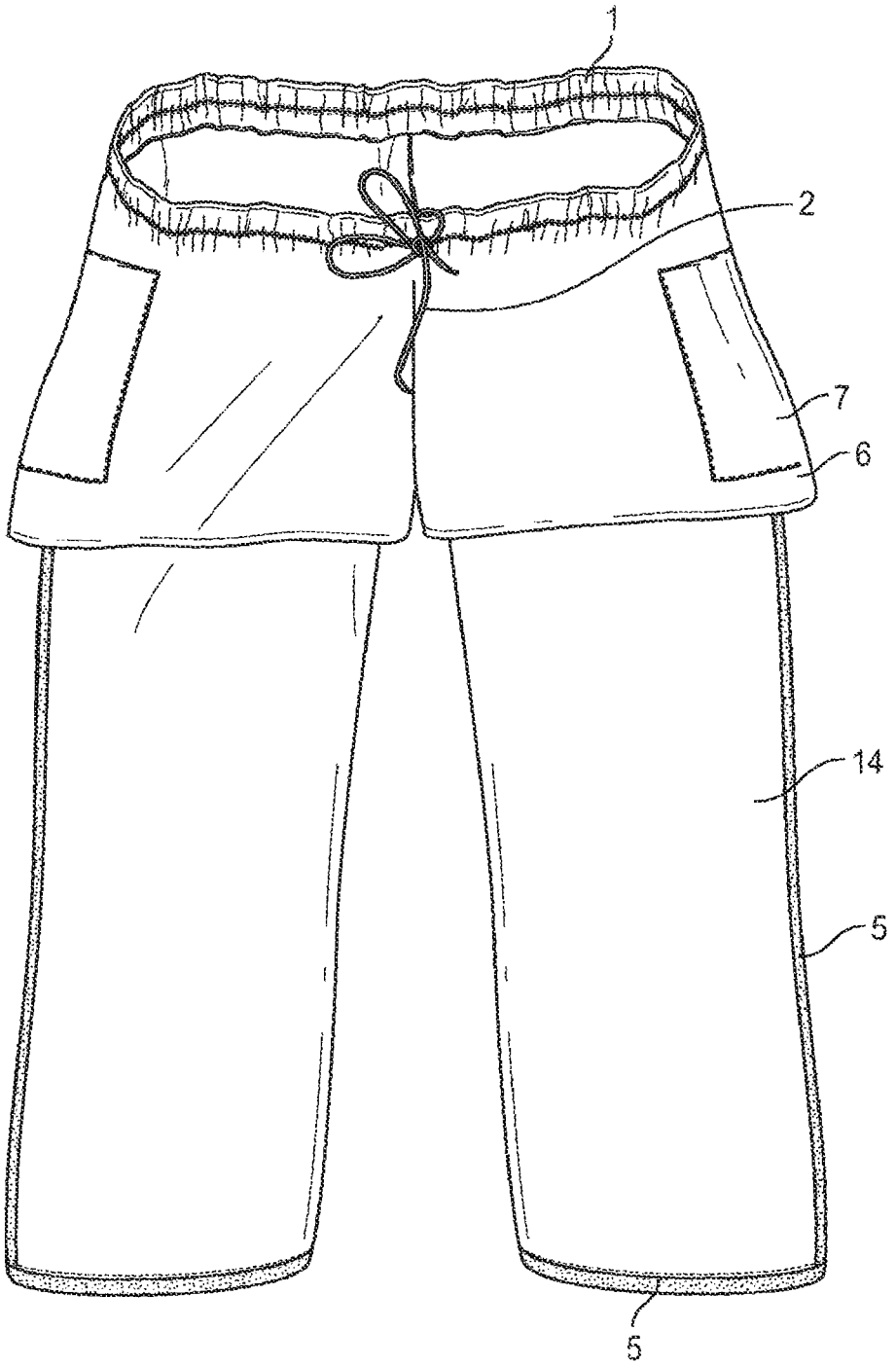
FIG. 9 is an interior front view of another embodiment of the invention with longer leg portions.

FIG. 9 is a front interior view of another embodiment of the invention with the outer layer 14 having longer leg portions. The basic concept behind the invention is preserved, with an elastic waistband 1, two pockets 7, and a comfortable seamless "boy short" style underwear inner layer 6. In this embodiment, the reflective layer 5 is sewn into the hip seams and on the bottom of the leg portions.

Figure 10:
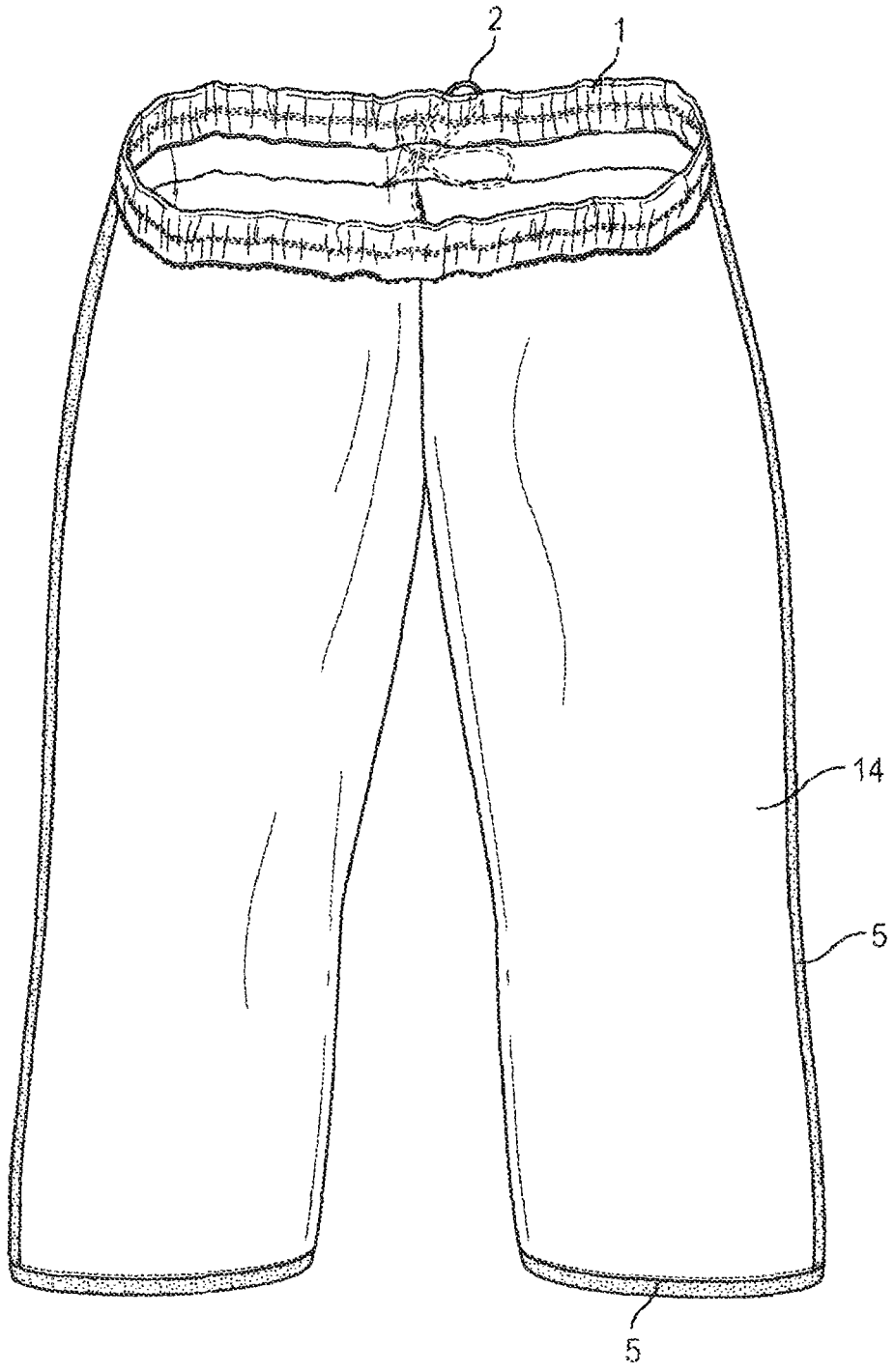
FIG. 10 is an exterior back view of the embodiment of the invention illustrated in FIG. 9, but not turned inside out.

FIG. 10 is an exterior back view of the embodiment of the invention illustrated in FIG. 9, but not turned inside out. The longer leg portions allow a wearer to stay warmer than with the shorts version previously described, and the longer reflective fabric 5 provides greater visibility for the wearer should he/she be out at night or in low visibility areas.

Figure 11:
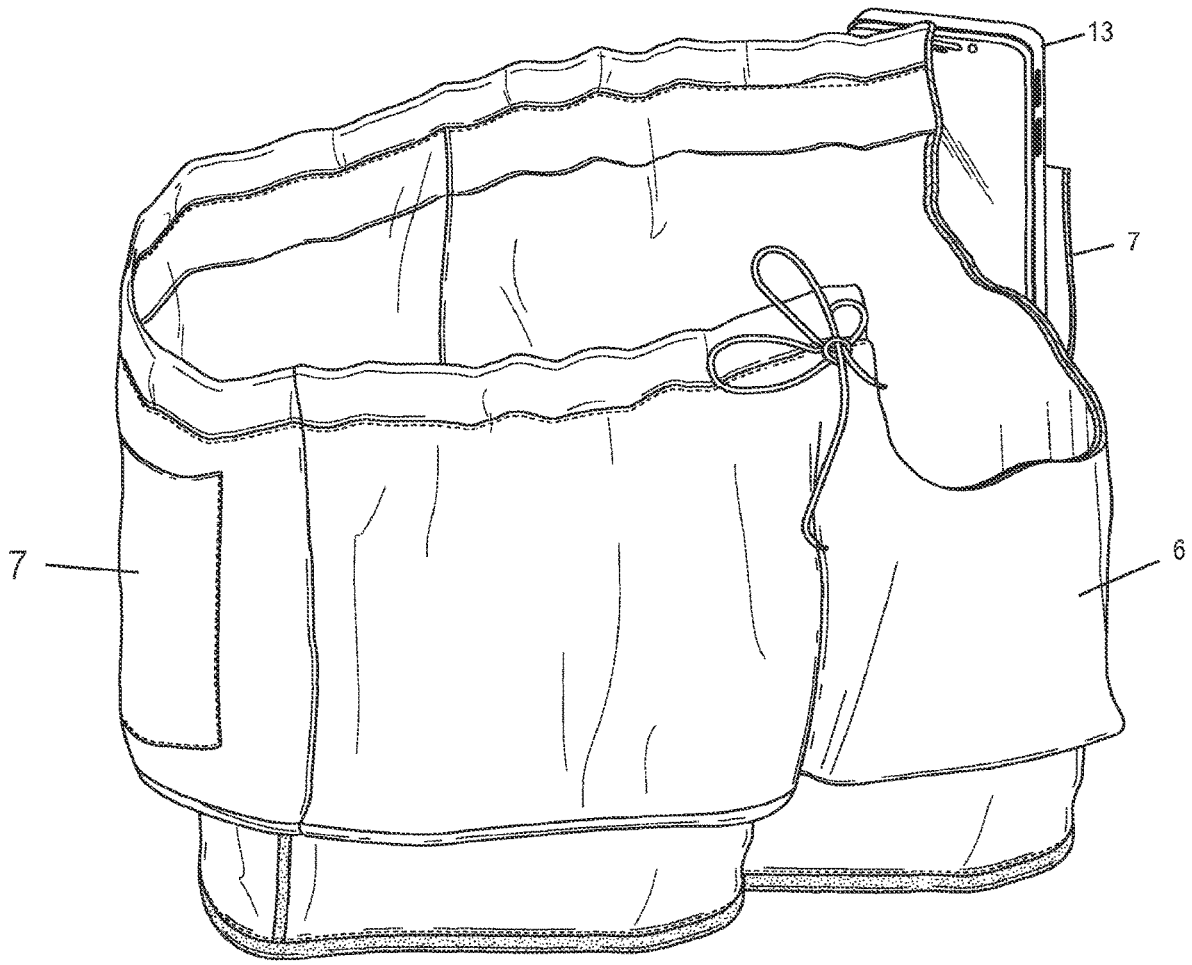
FIG. 11 is an interior, partial cut-away view showing how a cell phone can be slid into one of the pockets.

FIG. 11 is an interior, partial cut-away view showing how a cell phone can be slid into one of the pockets. The pocket 7 is attached to the inner layer 6 of the garment, and secures the cell phone 13 against the hip of the wearer. It should be noted that the location of the pocket is crucial to the effective functioning of the invention, and that locating it at the hips of the wearer prevents unwanted chafing, rubbing, bouncing or slapping as a wearer exercises. This figure also shows how locating the pocket on the inside of the inner layer provides protection against pickpocketing or the cell phone or other small items from falling out of the wearer's pocket.

Figure 12:
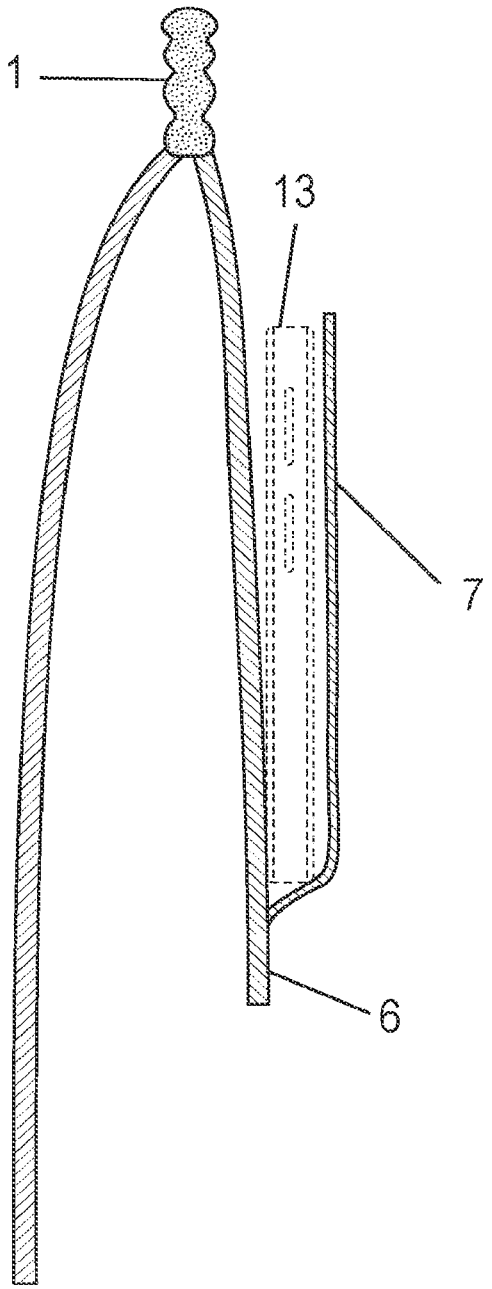
FIG. 12 is a cross sectional view showing the relationship between the two layers of fabric and the location of the pocket.

FIG. 12 is a cross sectional view showing the relationship between the two layers of fabric and the location of the pocket. The pocket 7 is attached to the inside of the inner layer 6. There is space above the pocket 7 and the waistband 1, and another space between the bottom of the pocket 7 and the bottom of the inner layer 6. The pocket is long enough to secure a cell phone 13, and narrow enough to prevent the cell phone from rotating side-to-side while running, walking, or exercising.

In a preferred embodiment, the invention provides a garment for exercising, walking, running, golfing, hiking, traveling, or jogging consisting of: an outer layer, an inner layer, and a waistband, with the outer layer and the inner layer are connected to a waistband bottom of the waistband, and where the inner layer has an outer side, an inner side, and an inner layer bottom, where there are one or more pockets disposed on the inner side of the inner layer, where each of the one or more pockets has a pocket bottom, two pocket sides, and a pocket opening, where the pocket bottom and the two pocket sides are stitched to the inner side of the inner layer, where there is a bottom space between the pocket bottom and the inner layer bottom, and there is a top space between the pocket opening and the waistband bottom.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A garment for securely carrying a device and/or other small items at the hips of a user while the garment is worn on the user's waist and at least partially covering the user's lower torso and legs below the user's waist, the garment comprising: an outer layer, an inner layer, and a waistband, where the outer layer and the inner layer are connected to the waistband, and where the inner layer has an outer side, an inner side, an inner layer upper end, an inner layer lower end, an inner layer front, an inner layer back, two inner layer sides, and an inner layer bottom, where there are one or more pockets directly sewn onto the inner side of the inner layer, where each of the one or more pockets has a pocket bottom, two pocket sides, and a pocket opening, where the pocket bottom and the two pocket sides are sewn directly to the inner side of the inner layer at each of two side portions of the inner layer, where the pocket opening is positioned below and spaced apart from the waistband bottom, where there is space between the pocket bottom and the inner layer bottom, and there is space between the pocket opening and the waistband bottom, each of the one or more pockets being sized and positioned on the inner side of the inner layer to cooperate with the inner layer for carrying the device and/or other small items snugly at the hips of the user, and where the inner layer is a seamless and knitted underwear, and the inner layer lower end is configured to terminate at an intersection of the user's lower torso between the user's legs, such that the inner layer does not bunch up, stretch out or cause chafing when the user is engaged in the activity.

2. The garment of claim 1, with each of the one or more pockets having a pocket height and a pocket width, and where the pocket height is greater than the pocket width.

3. The garment of claim 2, where the pocket height is approximately 7 inches, where the outer layer has an outer layer length, and where the inner layer has an inner layer length, and where the inner layer length is less than the outer layer length.

4. A garment for securely carrying a device and/or other small items at the hips of a user while the user is engaged in an activity and while the garment is worn on the user's waist and at least partially covering the user's lower torso and legs below the user's waist, the garment comprising: an outer layer, an inner layer, and a waistband, where the outer layer and the inner layer are connected to the waistband, and where the inner layer has an outer side, an inner side, an inner layer upper end, an inner layer lower end, an inner layer front, an inner layer back, two inner layer sides, and an inner layer bottom, where there are one or more pockets directly sewn onto the inner side of the inner layer, where each of the one or more pockets has a pocket bottom, two pocket sides, and a pocket opening, where the pocket bottom and the two pocket sides are sewn directly to the inner side of the inner layer at each of the two inner layer sides where the pocket opening is positioned below and spaced apart from a waistband bottom, where there is a bottom space between the pocket bottom and the inner layer bottom, and there is a top space between the pocket opening and the waistband bottom, the pocket opening configured to be accessible from the inner side of the inner layer, each of the one or more pockets being sized and positioned on the inner side of the inner layer to cooperate with the inner layer for carrying the device and/or other small items snugly at the hips of the user, and where the inner layer is a seamless and knitted underwear, and the inner layer lower end is configured to terminate at an intersection of the user's lower torso between the user's legs, such that the inner layer does not bunch up, stretch out or cause chafing when the user is engaged in the activity.

5. The garment of claim 4, with each of the one or more pockets having a pocket height and a pocket width, and where the pocket height is greater than the pocket width, and where the outer layer has an outer layer length, and where the inner layer has an inner layer length, and where the inner layer length is less than the outer layer length.

6. The garment of claim 4, where the outer layer consists of an outer surface and an inner surface, a front, a back, two sides; and a waistband section;

where the waistband section consists of an elasticized waistband with a waistband outer face, a waistband inner face, a waistband top and a waistband bottom, where there is a gap between the waistband outer face and the waistband inner face, and where there are two eyelet holes in the waistband inner face, and a continuous interior drawstring cord, where the continuous interior drawstring cord is non-elasticized, and where the continuous inner drawstring cord has two drawstring end sections and a drawstring middle section, and where the drawstring middle section is located in the gap, and where the two drawstring end sections extend from the gap through the eyelet holes, such that at least three inches of each of the two drawstring end sections extend through an outer side of the eyelet holes, and where the outer layer consists of four panels of material that extend from the waistband section, where the four panels of material have two hip seam intersections, where two of the four panels of material are sewn to each other at the two sides, and where two of the four panels of material are sewn to each other at the front and the back, and where each of the four panels of material terminate at a hem, and additionally, consisting of four lines of reflective material, where one of the four lines of reflective material are sewn on each of the hems and into each of the two hip seam intersections.

7. The garment of claim 6, where the outer layer is a short.

8. The garment of claim 6, where the outer layer is a capri pant.

9. The garment of claim 4, where the outer layer comprises an outer surface and an inner surface, a front, a back, two sides; and a waistband section;

where the waistband section comprises an elasticized waistband with a waistband outer face, a waistband inner face, a waistband top and a waistband bottom, where there is a gap between the waistband outer face and the waistband inner face, and where there are two eyelet holes in the waistband inner face, and a continuous interior drawstring cord, where the continuous interior drawstring cord is non-elasticized, and where the continuous inner drawstring cord has two drawstring end sections and a drawstring middle section, and where the drawstring middle section is located in the gap, and where the two drawstring end sections extend from the gap through the eyelet holes, such that at least three inches of each of the two drawstring end sections extend through an outer side of an eyelet hole, where the outer layer comprises four panels of material that extend from the waistband section, where the four panels of material have two hip seam intersections, where two of the four panels of material are sewn to each other at the two sides, and where two of the four panels of material are sewn to each other at the front and the back, and where each of the four panels of material terminate at a hem, where the inner layer is a seamless and knitted underwear, and where the inner layer lower end is configured to terminate at an intersection of the user's lower torso between the user's legs, such that the inner layer does not bunch up, stretch out or cause chafing when the user is engaged in the activity.

10. The garment of claim 9, additionally comprising four lines of reflective material, where one of the four lines of reflective material is sewn on each of the hems and one of the four lines of reflective material is sewn into each of the hip seam intersections.

11. The garment of claim 10, where the outer layer is a short where a length of the outer layer is longer than a length of the inner layer.

12. The garment of claim 4, where the outer layer has an outer section length, and where the outer section length extends below a lower edge of the inner layer and is adapted to extend above a foot of a wearer.

13. The garment of claim 9, where the hem is a straight hem.

14. The garment of claim 9, where the hem is a scalloped hem.

* * * * *